United States Patent [19]

Guillot

[11] Patent Number: 4,932,626

[45] Date of Patent: Jun. 12, 1990

[54] BREAKAWAY HANGER

[75] Inventor: Edmund P. Guillot, Putnam, Conn.

[73] Assignee: Gem Industries Inc., Gardner, Mass.

[21] Appl. No.: 347,868

[22] Filed: May 5, 1989

[51] Int. Cl.[5] ..... F16M 13/00

[52] U.S. Cl. ..... 248/548; 24/306; 248/74.3; 248/205.2; 248/900

[58] Field of Search ..... 248/548, 205.3, 900, 248/74.3, 68.1, 58, 64; 24/306, 444, 31 V

[56] References Cited

U.S. PATENT DOCUMENTS

| | | | |
|---|---|---|---|
| 2,387,951 | 10/1945 | Slater et al. | 248/68.1 |
| 2,560,845 | 7/1951 | Carpenter et al. | 248/58 |
| 2,567,463 | 9/1951 | Atkinson | 248/68.1 |
| 3,576,305 | 4/1971 | Welsh et al. | 248/68.1 |
| 3,633,857 | 1/1972 | Logan | 248/68.1 X |
| 4,395,009 | 7/1983 | Bromke | 248/68.1 |
| 4,638,966 | 1/1987 | Ford | 248/74.3 X |
| 4,706,914 | 11/1987 | Ground | 248/74.3 |

OTHER PUBLICATIONS

"Strap Retainer and Method of Utilization in Forming Exchange Cables", Giertz, Western Electric, Technical Dig., No. 26, Apr. 1972.

*Primary Examiner*—David L. Talbott
*Attorney, Agent, or Firm*—Charles R. Fay

[57] ABSTRACT

A breakaway hanger comprising a multi-slotted rod, and a separate strap of hook and loop material in adjacent slots i.e. in pairs, said straps dangling from the slotted rod and interengaged to form loops that break away when an excess weight is applied.

6 Claims, 1 Drawing Sheet

BREAKAWAY HANGER

FIELD OF THE INVENTION

Hangers, e.g. for supporting clothes hangers, that give way under sufficient weight, to open and discharge the clothes hanger or other weight hanging on the breakaway hanger.

BACKGROUND OF THE INVENTION

In some instances it would be desirable for a more or less conventional hanger to be capable of supporting only a certain weight, so that accidents would be avoided in the event a person put too much weight on the hook, or hook support. One example is to prevent a person from hanging himself by a noose slung on a coat hook or like member. This invention provides such a device, at small cost.

SUMMARY OF THE DISCLOSURE

A channel shaped rod is provided with a series of pairs of cross-slots in the bottom of the channel, and means is provided to secure the rod to an overhead base member with the two flanges of the channel pointed downwards. A first strap or elongated length of loop and hook securable material is thrust into and through one slot of a pair, the strap having a short entering end with pressure adhesive folded over the on the outside of the channel bottom for a length no greater than the distance between slots in a pair. This strap has e.g. the loop surface facing away from the other slot of the pair for a distance from the channel bottom as desired.

A second single and longer strap having e.g. the hook surface thrust through the other slot with the hook surface facing the loops trap. The second strap is folded over the pressure adhesively secured portion of the first strap at the outside bottom surface of the channel and so attached thereto and then the depending part of the hook strap is folded up and around the loop side of the first strap to the extent desired, and clamped by hand thereto. The length of the overlap determines the amount of weight that the hanger will accommodate, breaking away when too much weight is used, and being reusable at once.

PREFERRED EMBODIMENT OF THE INVENTION

Figure 1:
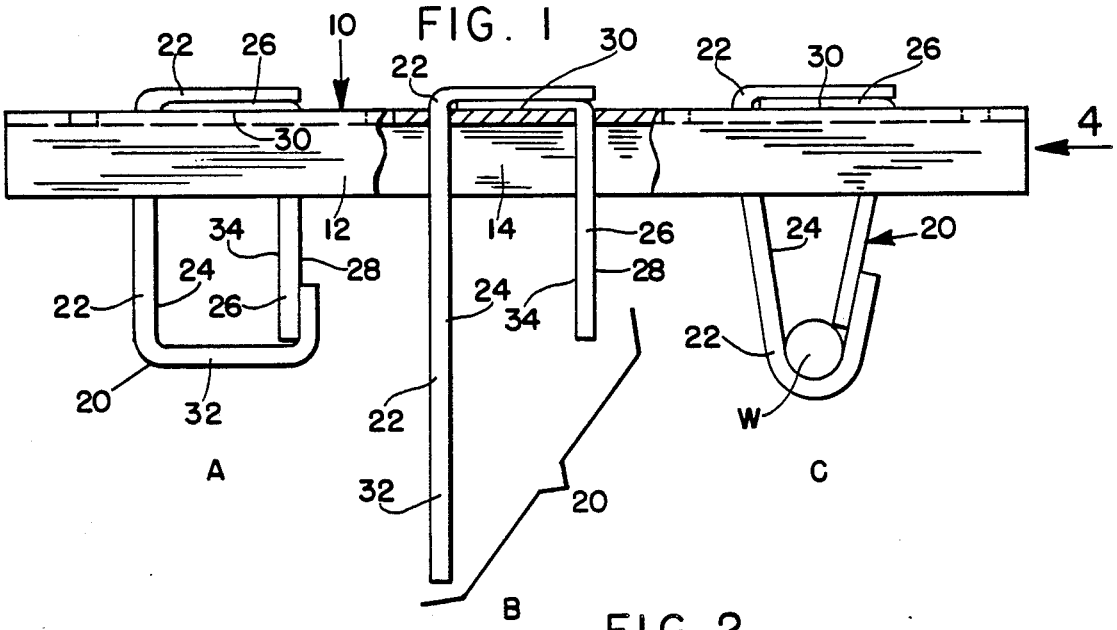
FIG. 1 is a side elevational view of the invention.

The numeral 10 designates a channel bar or iron having depending edge flange 12 and 14. There are as many pairs of cross-slots 16, 18 as may be needed or desired.

Two uneven lengths of hook and loops strap material are used to form each hanger, generally indicated at 20. One length, the longer strap for each hanger 20, is indicated at 22 for each hanger, and this strap has a hook surface 24 throughout one side that faces the other shorter loop surface strap 26, the loop surface being indicated at 28. The shorter strap 26 has the loop surface also throughout but a short surface at one end as at 30 is provided with a heavy, hand pressure type of pressure adhesive. The other sides of both straps 22 and 26, that is, the non hook and loop sides, are preferably plain fabric and are indicated as at 32. and 34.

The shorter strap 26 having at one side a partial surface with adhesive 30 at the leading end, is threaded through a slot 18 from the flanged side of the channel. The adhesive portion 30 is folded over the bottom of the channel toward its companion slot 16, anchoring the strap 26 to the channel. Then the other, longer strap 22 is threaded through the corresponding slot of a pair 16, and folded to overly the adhesive portion of the strap 26, and pressed down so that hook and loop parts of both straps coincide and become interengaged and thus attached to each other and to the bottom of channel 10. Strap 22 has its entire length hooked-surfaced at one side and plain fabric or the like at the other side. Strap 26 has a loop surface one entire side and the other side plain except for the pressure adhesive at 30.

Thus far, the two straps dangle in separate, spaced condition as at B in FIG. 1, and the loop and hook side surfaces face the same way, to the right. The end of strap 22 is turned up to lie outside strap 26 with loop surface facing hook surface, and the overlapping areas are pressed together, thus forming the closed loop at A. A weight W, such as the hook of a clothes hanger being placed in the loop 20, causes it to assume the V form as at C. The U shape of the loop 20 at A allows relatively large objects to be placed in the loop. When an undesirably great weight is so hung, the hook and loop connection between the two straps will break away and release the object sought to be supported. The length of overlap of the straps varies the weight at which the hanger loop breaks away. The channel with exposed ends of straps 22, can be secured to an overhead support by fasteners, adhesives, etc.

Figure 2:
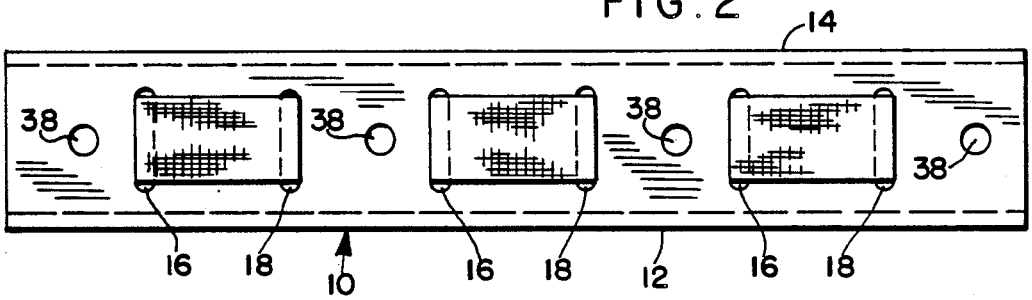
FIG. 2 is a top plan view thereof.
Figure 3:
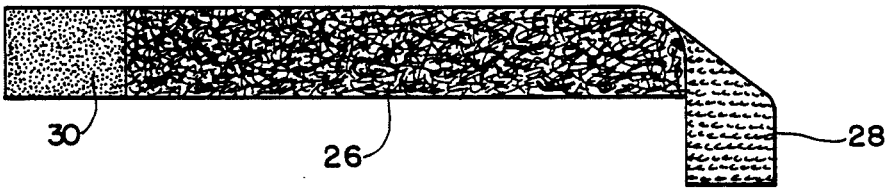
FIG. 3 is a detail of the hook and loop strap bearing the loops.
Figure 4:
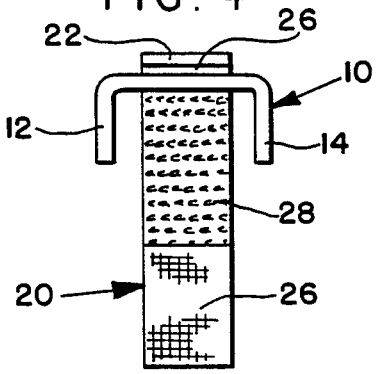
FIG. 4 is an end view looking in the direction of the arrow in FIG. 1.

The overlapped end portions of the straps at the channel bottom in the area of the adhesive 30 extend above the channel bottom as seen in FIG. 1 and 4, and therefore, should be device be e.g. screwed to an overhead support, not shown, the overlap areas of the straps act as pads that are squeezed down and flattened more and more according to the power applied to the screws which would extend up through the holes 38, FIG. 2. Hence, the overlaps would be practically impossible to come loose or break.

I claim:

1. A breakaway hanger for supporting a garment hanger or other weight designed to breakaway upon the application of a weight to the hanger exceeding a predetermined weight substantially greater than the normal weight of a garment or other weight comprising a first support adapted to be mounted beneath another support and firmly secured thereto, a first flexible strap attached to said first support in a dangling relation thereto and having an end remote from said first support.

a second flexible strap attached to said first support in a dangling relation thereto and being in parallel spaced relation to said first strap, said second strap having an end remote from said first support, said first and second straps being of unequal length, one of said straps having one of a pair of mating hook and loop connecting surfaces adapted to provide a separable connection between said first and second straps when said remote ends of said straps are overlapped and pressed together, and the other of said straps having the other of said mating hook and loop connecting surfaces, the respective mating hook and loop connecting surfaces of said straps normally facing in the same direction while the straps are dangling from said first support, the remote end of the longer of said first and second straps being reversed to lie in at least partially overlapping relation to the shorter of said first and second straps in a manner causing said mating hook and loop connecting surfaces to be breakaway connected to form a loop dangling from said first support, said breakaway connection being separable upon the application of a weight to the loop formed between said first and second straps which substantially exceeds the normal weight of a garment or other weight for which said hanger is designed, the weight required to cause separation being variable in proportion to the length of overlap between the remote ends of said straps.

2. The breakaway hanger of claim 1 wherein said first support includes a flat elongated member with slots in spaced pairs extending transversely thereof, said first and second straps having end portions opposite said remote ends which protrude upwardly through a pair of said slots, one strap to a slot, the upwardly protruding end portions of said straps being overlapped with their mating hook and loop connecting surfaces facing each other.

3. The breakaway hanger of claim 2 wherein the protruding strap end portion of one of said straps faces said first support and has pressure activated adhesive thereon which is adhered to said first support.

4. The breakaway hanger of claim 3 wherein the overlapped upwardly protruding end portions of said straps are located to be held between said first support and the other support beneath which said first support is adapted, to be mounted.

5. The breakaway hanger of claim 1 wherein said first support is a channel bar including an elongated bottom adapted to be supported horizontally beneath said other support and elongated flanges on the edges thereof, said flanges extending in the same direction and being flat, parallel and spaced, a series of pairs of cross-slots in said bottom, a pair of said first and second flexible straps for each pair of cross-slots, said straps having widths substantially alike and end portions opposite said remote ends which are extended upwardly through the slots of one pair of cross-slots, one strap to a slot, and folded over upon each other above said bottom with their mating hook and loop connecting surfaces facing each other and connected in overlapping relation between the slots of one pair of slots.

6. The breakaway hanger of claim 5 wherein the upwardly extended end portion of one of said straps is folded over in contact with said bottom, and pressure activated adhesive on said upwardly extended end portion in contact with said bottom which adhesively secures said folded over end portion to said bottom.

* * * * *